United States Patent [19]

Takeda

[11] Patent Number: 4,785,508

[45] Date of Patent: Nov. 22, 1988

[54] FEMALE MEMBER OF SNAP FASTENER

[76] Inventor: Tadashi Takeda, 12 Banchi, 1 Chome, Kita-kinomoto, Yao-city, Osaka, Japan

[21] Appl. No.: 105,575

[22] Filed: Oct. 8, 1987

[30] Foreign Application Priority Data

Oct. 18, 1986 [JP] Japan ..... 61-159863[U]

[51] Int. Cl.[4] ..... A44B 1/18

[52] U.S. Cl. ..... 24/90 C; 24/90 R; 24/90 TA

[58] Field of Search ..... 24/90 C, 90 R, 90 TA, 24/111, 90 A, 90 E, 90 HA, 103, 94, 93, 621, 623

[56] References Cited

U.S. PATENT DOCUMENTS

| | | | |
|---|---|---|---|
| 53,472 | 3/1866 | Palmer | 24/90 R |
| 627,961 | 7/1899 | Adams | 24/621 |
| 1,562,724 | 11/1925 | Redfield | 24/90 C |
| 2,264,185 | 11/1941 | Novick | 24/90 TA |
| 2,451,077 | 10/1948 | Emsig | 24/90 TA |
| 3,644,965 | 2/1972 | Kahn | 24/90 R |
| 4,471,510 | 9/1984 | DeRosa | 24/90 TA |

*Primary Examiner*—Victor N. Sakran

*Attorney, Agent, or Firm*—Wenderoth, Lind & Ponack

[57] ABSTRACT

Even though a female member is sewed on a suit material of clothes with any surface thereof directing upward, a function proper to the female member can be exhibited by the female member comprising a central ring-shaped portion provided with a through hole with which a projecting portion of a male member is detachably engageable, four projecting pieces radially projecting outward from said central ring-shaped portion and an outside ring-shaped portion for connecting said projecting pieces to each other at a pointed end thereof integrally formed of resinous material, adapting to sew said projecting piece on a suit material of clothes, forming a radial slit communicating with said through hole in said central ring-shaped portion and each of said projecting pieces, and symmetrically forming the face and the back thereof as a whole.

4 Claims, 3 Drawing Sheets

FEMALE MEMBER OF SNAP FASTENER

BACKGROUND OF THE INVENTION

1. Field of the Invention

The present invention relates to a female member of a snap fastener, in particular to a female member used by sewing it on clothes, such as blouse, with a thread.

2. Description of the Prior Art

A female member of this type having a construction, in which a cylindrical member 42 provided with a dented portion 41, in which a projecting portion of a male member is inserted, is projected from a center of a base member 40 made of a metal, such as brass, said cylindrical member 42 being provided with an almost S letter-shaped bent clip spring 43 on a base portion thereof, as shown in FIG. 8, has been known for a long time. Reference numeral 44 designates a sewing hole.

However, a female member having the above described construction is strong and durable but the minute clip spring 43 must be calked on the base member 40 after the base member 40 was worked in an appointed shape. That is to say, a disadvantage has occurred in that the manufacturing process is complicated and the cost of production is increased. Also the following disadvantages have occurred.

That is to say, recently clothes and the like have a tendency to be produced by means of a machine, that is to say to be "automatically" produced, and as a result, to be mass-produced. However, with the above described conventional female member, since the base member 40 is provided with the clip spring 43 on one side (the opposite surface side) thereof, its face and back can not but being unsymmetrical. Moreover, since a female member of this type is generally remarkably small and flat in shape, it has been difficult to distinguish its face from its back by means of an automatic sorting machine. This has been an obstacle to the automatization of sewing. In addition, also in the case of hand-sewing, for example it is necessary to pay close attention to the discrimination between the face and the back of the female member. This has led to an increase of the cost of production of clothes.

In addition, although the production of a female member by molding resins have been tried many times, merely the elasticity of resins themselves used as materials has been utilized, that is to say it has never possessed the structural elasticity which is an essenstial function proper to the member. In short, a dented portion of a female member, in which a projecting portion of a male member is to be inserted, has never structurally possessed the elastical function but an inside circumference of the dented portion of the female member has been slightly reduced than an outside circumference of the projecting portion of the male member to put the male member in the female member utilizing the flexibility of resinous material themselves of each member. Accordingly, a problem has occurred also in that an engaging manner determining the proper quality of metallic members obtained by utilizing a clip spring has never been obtained and the durability, such as engaging strength and holding power, is lowered due to the engaging operation repeated many times.

SUMMARY OF THE INVENTION

It is an object of the present invention to eliminate the above described conventional disadvantages, in particular to provide a female member and a male member of a snap fastener capable of holding a manner determining the proper quality of the member themselves, which has been able to obtain by the conventional metallic female member, and the durability and making the discrimination between the face and the back, which has been inevitable in the metallic female member, unnecessary, and having advantages such as the elimination of the coldness to the skin, colorfulness and rustlessness which have been the proper characteristics of resinous materials.

In order to achieve the above described object, the present invention takes the following technical measures. That is to say, the present invention is characterized by that a central ring-shaped portion provided with a through hole with which a projecting portion of a male member is engageable, four projecting pieces radially projecting outward from said central ring-shaped portion and an outside ring-shaped portion for connecting said projecting pieces to each other at a pointed end thereof are integrally formed of synthetic resinous materials, said projecting pieces being adapted to be sewed on clothes, said central ring-shaped portion and each of said projecting pieces being provided with a radial slit formed so as to communicate with said through hole, and the face and the back being symmetrically formed as a whole.

BRIEF DESCRIPTION OF THE DRAWINGS

A first preferred embodiment of the present invention is shown in FIGS. 1 to 4, in which.

A second preferred embodiment of the present invention is shown in FIGS. 5 to 7, in which.

DESCRIPTION OF THE PREFERRED EMBODIMENTS

Figure 1:
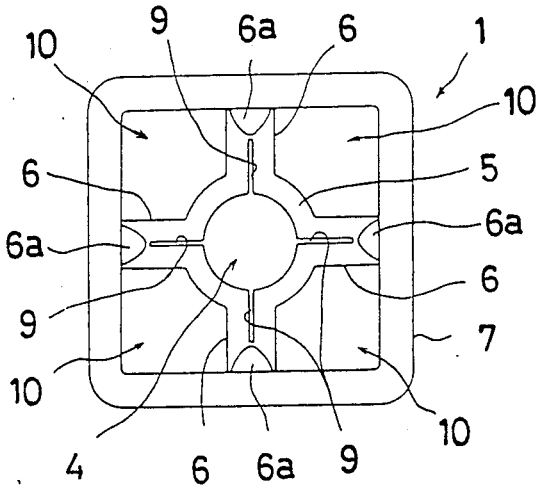
FIG. 1 is a plan view showing a female member of a snap fastener.
Figure 2:
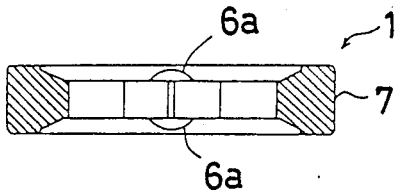
FIG. 2 is a sectional view showing said female member.
Figure 3:
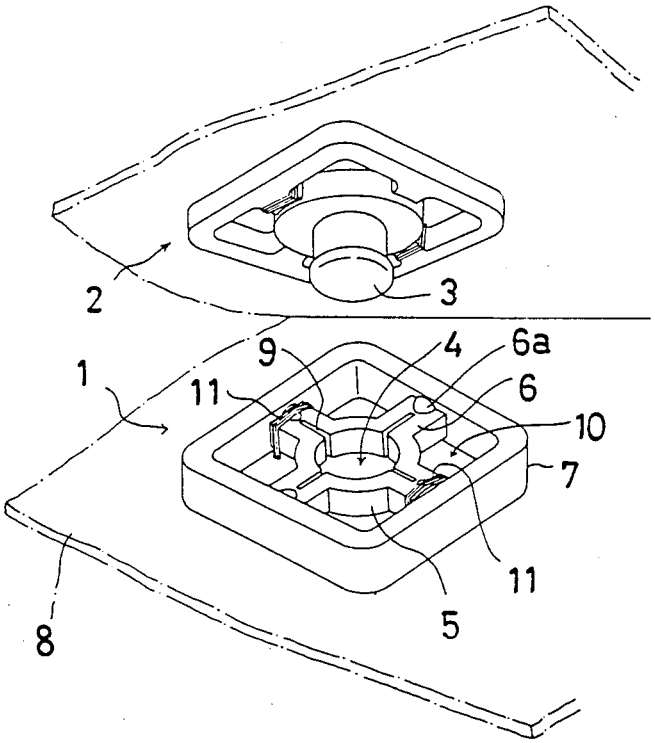
FIG. 3 is a perspective view showing said female member and a male member which is engageable with said female member.
Figure 4:
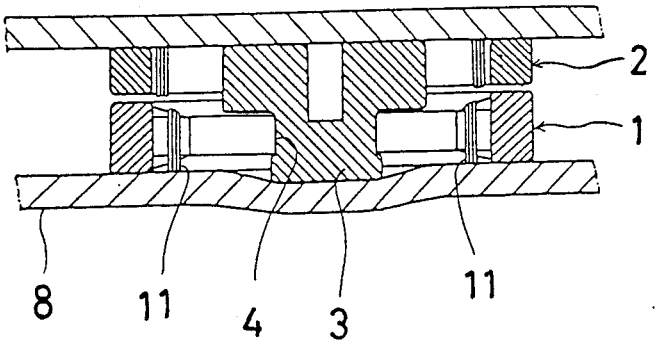
FIG. 4 is a sectional view showing said female member and said male member under the connected condition.

The present invention will be below described with reference to FIGS. 1 to 4 showing the first preferred embodiment thereof.

Referring now to FIGS. 1 to 4, reference numeral 1 designates a female member comprising a central ring-shaped portion 5 provided with a through hole 4 with which a projecting portion 3 of a male member 2 is engageable, four projecting pieces 6 - - - radially projecting outward from said central ring-shaped portion 5 and an outside ring-shaped portion 7 for connecting said projecting pieces 6 - - - to each other at a pointed end thereof integrally formed of synthetic resinous materials by the injection molding method so that the face and the back may be symmetrically formed. And, said projecting pieces 6 - - - are adapted to be sewed on a suit material of clothes at the pointed end side portion thereof, and said central ring-shaped portion 5 and each of said projecting pieces 6 - - - are provided with a radial slit 9 - - - communicating with said through hole 4. A thickness of said projecting pieces 6 - - - is slightly less than that of said outside ring-shaped portion 7, and each of said projecting pieces 6 - - - is provided with a reinforcing rib 6a- - - formed on both the face and the back at an end portion of a side of the outside ring-shaped portion 7. Reference numeral 10 designates a sewing space portion.

With the above described construction, since the female member 1 is formed of synthetic resins as a whole, it can be easily and inexpensively mass-produced by the injection molding method and the washing of clothes do not lead to the generation of rust.

And, even though resins as materials are relatively hard, the sufficient flexibility and quantity of deformation can be obtained by the radial slit 9 - - - formed in the central ring-shaped portion 5 and the individual projecting pieces 6 - - - , and even after the repeated engagement of the projecting portion 3 of the male member 2 the through hole 4 of the central ring-shaped portion 5 does not extend and accordingly, the stabilized snapping operation can be achieved for a long time.

In addition, since the face and the back of the female member 1 are symmetrical, a function proper to the female member 1 can be exhibited even though the female member 1 is sewed on the suit material of clothes with any surface directing upward.

That is to say, in the sewing operation of the female member 1 we can do without paying attention to the face and the back of the female member 1 and as a result, the sewing operation can be easily and speedily carried out. In particular, since the face and the back of the female member 1 are symmetrical, in the automatization of the sewing operation a mechanism for discriminating between the face and the back of the female member 1 and a mechanism for arranging the female member 1 in an appointed direction (so that the face may be placed upside) are not required, whereby the sewing operation by an automatic machine is easy.

Besides, even though the female member 1 is sewed on the suit material of clothes with any surface directing upward, a step is formed between an upper surface of the projecting pieces 6 - - - and an upper surface of the outside ring-shaped portion 7, and as a result, threads 11 - - -, with which the portion of the projecting pieces 6 - - - is sewed on the suit material 8 of clothes, can be positioned lower than the upper surface of the outside ring-shaped portion 7. Accordingly, the threads 11 - - - can be prevented from being caught on other things to be cut.

Figure 5:
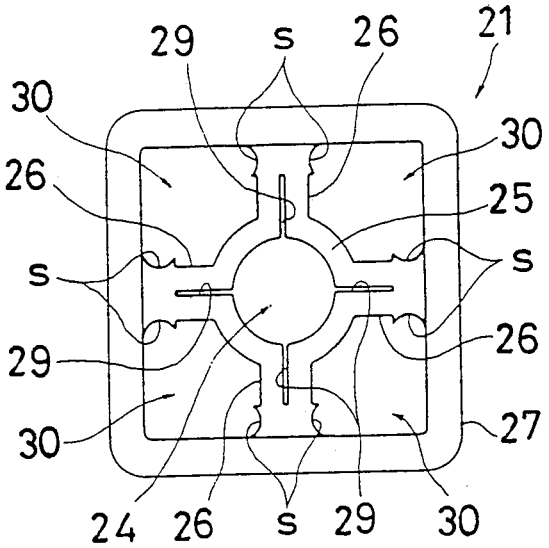
FIG. 5 is a plan view showing a female member of a snap fastener.
Figure 6:
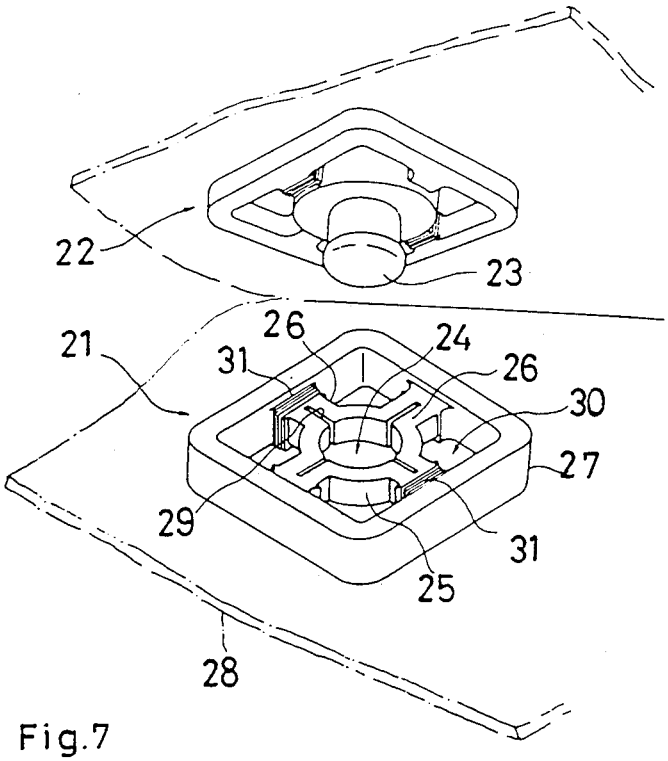
FIG. 6 is a perspective view showing said female member and a male member which is engageable with said female member.
Figure 7:
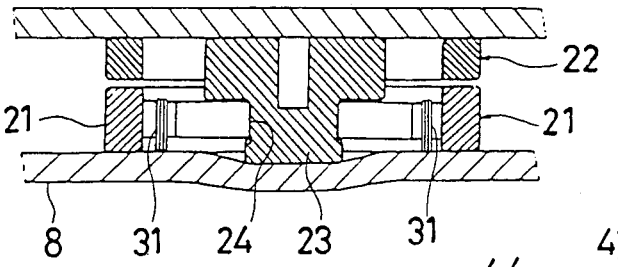
FIG. 7 is a sectional view showing said female member and said male member under the connected condition.
Figure 8:
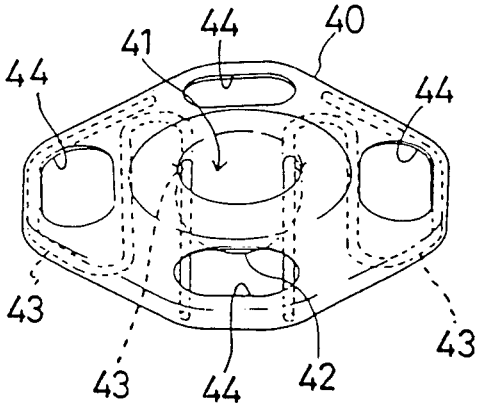
Fig.8 PRIOR ART
FIG. 8 is a perspective view showing the conventional example.

FIGS. 5 to 7 show a second preferred embodiment of the present invention. Referring to FIGS. 5 to 7, reference numeral 21 designates a female member, of which face and back are symmetrical, comprising a central ring-shaped portion 25 provided with a through hole 24 with which a projecting portion 23 of a male member 22 is detachably engageable, four projecting pieces 26 - - - radially projecting outward from said central ring-shaped portion 25 and an outside ring-shaped portion 27 for connecting said projecting pieces 26 - - - to each other at a pointed end thereof integrally formed of synthetic resinous materials by the injection molding method. And, said projecting pieces 26 - - - are adapted to be sewed on a suit material 28 of clothes at the pointed end side portion thereof, and said central ring-shaped portion 25 and each of said projecting pieces 26 - - - are provided with a radial slit 29 - - - communicating with said through hole 24.

And, each projecting piece 26 is provided with a skid-preventing concave portion s for preventing a sewing thread 31 from skidding on both sides of a pointed end side portion thereof. In addition, in order to prevent the oppression of the pointed end side portion of the projecting pieces 26 - - - by the thread 31 and the resulting reduction of a diameter of the through hole 24 when the pointed end side portion of the projecting pieces 26 - - - is sewed on the suit material 28 of clothes, a pointed end of each slit 29 is positioned inside said skid-preventing concave portion s. Reference numeral 30 designates a sewing space portion.

Also the female member 21 constructed in such a manner exhibits the same effects as those of the female member 1 in the above described first preferred embodiment. In addition, since each projecting piece 26 is provided with the skid-preventing concave portion s for preventing the sewing thread 31 from skidding on both side surfaces of the pointed end side portion thereof, the sewing is easy to carry out and the thread does not slip out of position after sewed. Furthermore, since the pointed end of the outside ring-shaped portion 27 side of the slits 29 - - - formed in the projecting pieces 26 - - - is adapted to be positioned inside said skid-preventing concave portions s, an advantage occurs in that the compression of the slits 29 - - - by the sewed thread 31 and the resulting reduction of the diameter of the through hole 24 is prevented.

What is claimed is:

1. A female member of a snap fastener comprising:

a central ring-shaped portion having a through-hole for detachably receiving a projecting portion of a male member of a snap fastener;

a plurality of projecting pieces integrally attached to said central ring-shaped portion and projecting radially outwardly therefrom, each said projecting piece having means for receiving thread thereon when said female member is sewn by thread onto a piece of fabric, and adjacent ones of said projecting pieces defining sewing space portions therebetween;

an outside ring-shaped portion integrally attached to each said projecting piece and surrounding said plurality of projecting pieces and said central ring-shaped portion;

said central ring-shaped portion, said plurality of projecting pieces, and said outside ring-shaped portion being unitary, being substantially flat, and being substantially symmetric with respect to a common plane passing through the middle of said central ring-shaped portion, through the middle of each one of said plurality of projecting pieces, and through the middle of said outside ring-shaped portion;

a reinforcing means integrally attached to each one of said plurality of projecting pieces and integrally attached to said outside ring-shaped portion for strengthening the attachment thereof; and each one of said plurality of projecting pieces having a radial slit defined therein, each said radial slit extending from said through-hole in said central ring-shaped portion toward said outside ring-shaped portion and terminating before said reinforcing means, each said radial slit allowing elastic deformation of said central ring-shaped portion when said central ring-shaped portion receives the projecting portion of a male member of a snap fastener.

2. A female member of a snap fastener as in claim 1, wherein said thread receiving means on each said projecting piece is a skid-preventing substantially concave portion for holding thread in place, and said concave portion is between said slit and said outside ring-shaped portion.

3. A female member of a snap fastener as in claim 2, wherein each said radial slit is substantially perpendicular to the common plane.

4. A female member of a snap fastener as in claim 3, wherein said female member is a hard synthetic resin.

* * * * *